US005685090A

United States Patent [19]

Tawney et al.

[11] Patent Number: 5,685,090

[45] Date of Patent: Nov. 11, 1997

[54] CUSHIONING SYSTEM FOR SHOE SOLE AND METHOD FOR MAKING THE SOLE

[75] Inventors: John C. Tawney, Portland; Bruce J. Kilgore, Lake Oswego, both of Oreg.

[73] Assignee: Nike, Inc., Beaverton, Oreg.

[21] Appl. No.: 571,701

[22] Filed: Dec. 13, 1995

Related U.S. Application Data

[63] Continuation of Ser. No. 37,452, Mar. 26, 1993, abandoned.

[51] Int. Cl.[6] ..... A43B 13/20; A43B 21/26; A43B 21/36

[52] U.S. Cl. ..... 36/29; 36/35 R; 36/36 R

[58] Field of Search ..... 36/29, 28, 2 B, 36/3 R, 71, 35 R, 37, 36 R

[56] References Cited

U.S. PATENT DOCUMENTS

| | | | |
|---|---|---|---|
| 1,766,311 | 6/1930 | Shaft | 36/37 X |
| 2,491,280 | 12/1949 | Roth | 36/37 X |
| 3,044,190 | 7/1962 | Urbany | 36/35 R X |
| 4,008,530 | 2/1977 | Gager | 36/29 X |
| 4,100,686 | 7/1978 | Sgarlato et al. | 36/29 |
| 4,219,945 | 9/1980 | Rudy | 36/29 |
| 4,342,158 | 8/1982 | McMahon et al. | 36/35 R |
| 4,551,930 | 11/1985 | Graham et al. | 36/30 R |
| 4,557,060 | 12/1985 | Kawashima | 36/44 |
| 4,561,140 | 12/1985 | Graham et al. | 36/30 R X |
| 4,610,099 | 9/1986 | Signori | 36/3 B |
| 4,654,983 | 4/1987 | Graham et al. | 36/30 R |
| 4,768,295 | 9/1988 | Ito | 36/29 X |
| 4,815,221 | 3/1989 | Diaz | 36/28 X |
| 4,817,304 | 4/1989 | Parker et al. | 36/114 |
| 4,918,838 | 4/1990 | Chang | 36/29 X |
| 4,974,345 | 12/1990 | Yung-Mao | 36/114 |
| 5,005,300 | 4/1991 | Diaz et al. | 36/114 |
| 5,042,176 | 8/1991 | Rudy | 36/29 |
| 5,077,915 | 1/1992 | Gross | 36/31 |
| 5,092,060 | 3/1992 | Frachey et al. | 36/29 |
| 5,134,790 | 8/1992 | Woitschaetzke et al. | 36/28 |
| 5,201,125 | 4/1993 | Shorten | 36/29 |
| 5,220,737 | 6/1993 | Edington | 36/29 X |

*Primary Examiner*—B. Dayoan

*Attorney, Agent, or Firm*—Banner & Witcoff, Ltd.

[57] ABSTRACT

The present invention provides a cushioned shoe sole having an outer sole layer for contacting the ground surface and a midsole layer disposed above the outer sole layer including an opening formed vertically through at least the top surface thereof. An inflatable bladder element having an unobstructed interior cavity is inflatable with a fluid medium and removably positioned in the opening in the midsole layer. When inflated and snapped into position in the opening, the bladder is therefore visible through at least the top surface of the midsole.

The present invention also provides a method of making a cushioned shoe sole by forming an inflatable bladder with a hollow interior cavity defined within the perimeter of the bladder forming a foam midsole having an opening generally extending in the vertical plane and a peripheral cavity around at least a portion of the perimeter of the opening. Thereafter, snapping the inflatable bladder into the preformed opening in the foam midsole such that the perimeter of the bladder is disposed within the cavity of the opening and a cushioned shoe sole is obtained. The bladder can also be viewed through an opening in the top and/or bottom surfaces of the midsole.

38 Claims, 5 Drawing Sheets

CUSHIONING SYSTEM FOR SHOE SOLE AND METHOD FOR MAKING THE SOLE

This application is a continuation of application Ser. No. 08/037,452, filed Mar. 26, 1993 abandoned.

TECHNICAL FIELD

The present invention relates to a cushioning system for a shoe sole and, more particularly, to an inflated bladder which is positionable in a preformed shoe midsole of an athletic shoe. The present invention also relates to a method for making the shoe sole.

BACKGROUND OF THE INVENTION

Basketball, tennis, running, and aerobics are but a few of the many popular athletic activities which produce a substantial impact on the foot when the foot strikes the ground. To cushion the strike force on the foot, as well as the leg and connecting tendons, the sole of shoes designed for such activities typically include several layers, including a resilient, shock absorbent layer such as a midsole and a ground contacting outer sole or outsole which provides both durability and traction.

The typical midsole uses one or more materials or components which affect the force of impact in two important ways, i.e., through shock absorption and energy absorption. Shock absorption involves the attenuation of harmful impact forces to thereby provide enhanced foot protection. Energy absorption is the dissemination of both impact and useful propulsive forces. Thus, a midsole with high energy absorbing characteristics generally has a relatively low resiliency and, conversely, a midsole with low energy absorbing characteristics generally has a relatively high resiliency. The optimum midsole should be designed with an impact response that takes into consideration both adequate shock absorption and sufficient resiliency.

One type of sole structure in which attempts have been made to design appropriate impact response is soles, or inserts for soles, that contain a bladder element of either a liquid or gaseous fluid. These bladder elements are either encapsulated in place during the foam midsole formation or dropped into a shallow, straight walled cavity and cemented in place, usually with a separate piece of foam cemented on top. Particularly successful gas filled structures are disclosed in U.S. Pat. Nos. 4,183,156 and 4,219,945 to Marion F. Rudy, the contents of which are hereby incorporated by reference. An inflatable bladder or barrier member is formed of an elastomer material having a multiplicity of preferably intercommunicating, fluid-containing chambers inflated to a relatively high pressure by a gas having a low diffusion rate through the bladder. The gas is supplemented by ambient air diffusing through the bladder to thereby increase the pressure therein and obtain a pressure that remains at or above its initial value over a period of years. (U.S. Pat. Nos. 4,340,626, 4,936,029 and 5,042,176 to Marion F. Rudy describe various improvements in diffusion and are also hereby incorporated by reference.) The inflatable bladder insert is incorporated into the insole structure, in the '156 patent, by placement within a cavity below the upper, e.g., on top of a midsole layer and within sides of the upper or midsole. In the '945 patent, the inflatable bladder insert is encapsulated within a yieldable foam material, which functions as a bridging moderator filling in the irregularities of the bladder, providing a substantially smooth and contoured surface for supporting the foot and forming an easily handled structure for attachment to an upper. The presence of the moderating foam, however, detracts from the cushioning and perception benefits of the gas inflated bladder. Thus, when the inflated bladder is encapsulated in a foam midsole, the impact response characteristics of the sole structure formed by the combination is determined by the combined effects of the two elements.

The manufacturing techniques used to produce the sole structure formed by the combination of the foam midsole and inflated bladder must also be accommodating to both elements. For example, when encapsulating the inflatable bladder, only foams with relatively low processing temperatures can be used due to the susceptibility of the bladder to deform at high temperatures. The inflated bladder must also be designed with a thickness less than that of the midsole layer in order to allow for the presence of the foam encapsulating material completely therearound. Thus, there are manufacturing as well as performance constraints imposed in the foam encapsulation of an inflatable bladder.

SUMMARY OF THE INVENTION

The present invention is designed as an improvement to a sole structure utilizing the combination of an inflatable bladder and a foam midsole. The present invention provides greater versatility in the manufacturing of each component and greater performance and perception benefits from the use of a gas filled bladder.

The present invention provides a cushioned shoe sole having an outer sole layer for contacting the ground surface, a midsole layer disposed above the outer sole layer and having a top surface and a bottom surface. The midsole layer is formed of a resilient elastomeric material and includes an opening formed vertically through at least a portion of the midsole layer. An inflatable bladder element having a top surface, a bottom surface, and a perimeter area is removably positioned in the opening in the midsole layer. The bladder element has an unobstructed interior cavity within the perimeter area that is inflatable with a gaseous substance. In a preferred embodiment, the top surface of the inflated bladder is exposed through the top surface of the midsole layer. In a further embodiment, the outer sole layer includes an opening at least partially corresponding to the opening in the midsole layer such that the bottom surface of the inflated bladder is exposed through the opening in the outer sole layer. Thus, if the bladder is formed from a transparent material, vertical plane visibility can be obtained through the sole of the shoe.

The present invention also provides a method for forming a sole. The method includes the steps of forming an inflatable bladder from an elastomeric material that has a hollow interior cavity defined within the perimeter thereof. A midsole layer is formed from a foam elastomeric material to define a midsole extending in longitudinal, transverse and vertical directions, and having opposing upper and lower major surfaces. An opening is formed through at least one of the major surfaces of the midsole and extends vertically into the interior of the midsole. A peripheral cavity is also defined around at least a major portion of the perimeter of the opening. Thereafter, the bladder is inserted into the opening in the midsole such that the perimeter of the bladder is securely positioned within the peripheral cavity.

BRIEF DESCRIPTION OF THE DRAWINGS

The above description and other objects, advantages, and features of the present invention will be more fully understood and appreciated by reference to the specification and accompanying drawings, wherein.

DETAILED DESCRIPTION OF THE PREFERRED EMBODIMENTS

Figure 1:
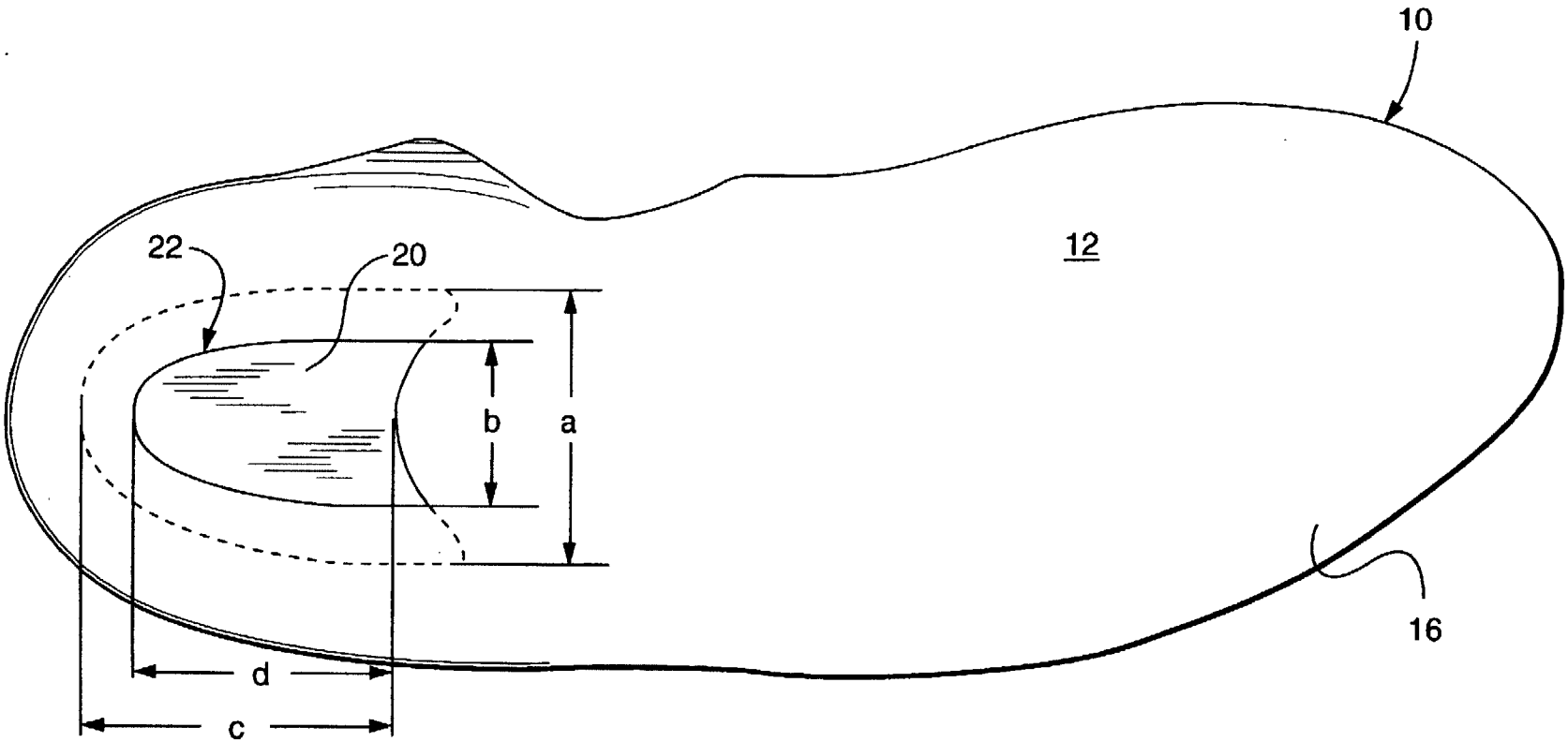
FIG. 1 is a top plan view of a shoe sole incorporating an air bladder according to the present invention.
Figure 2:
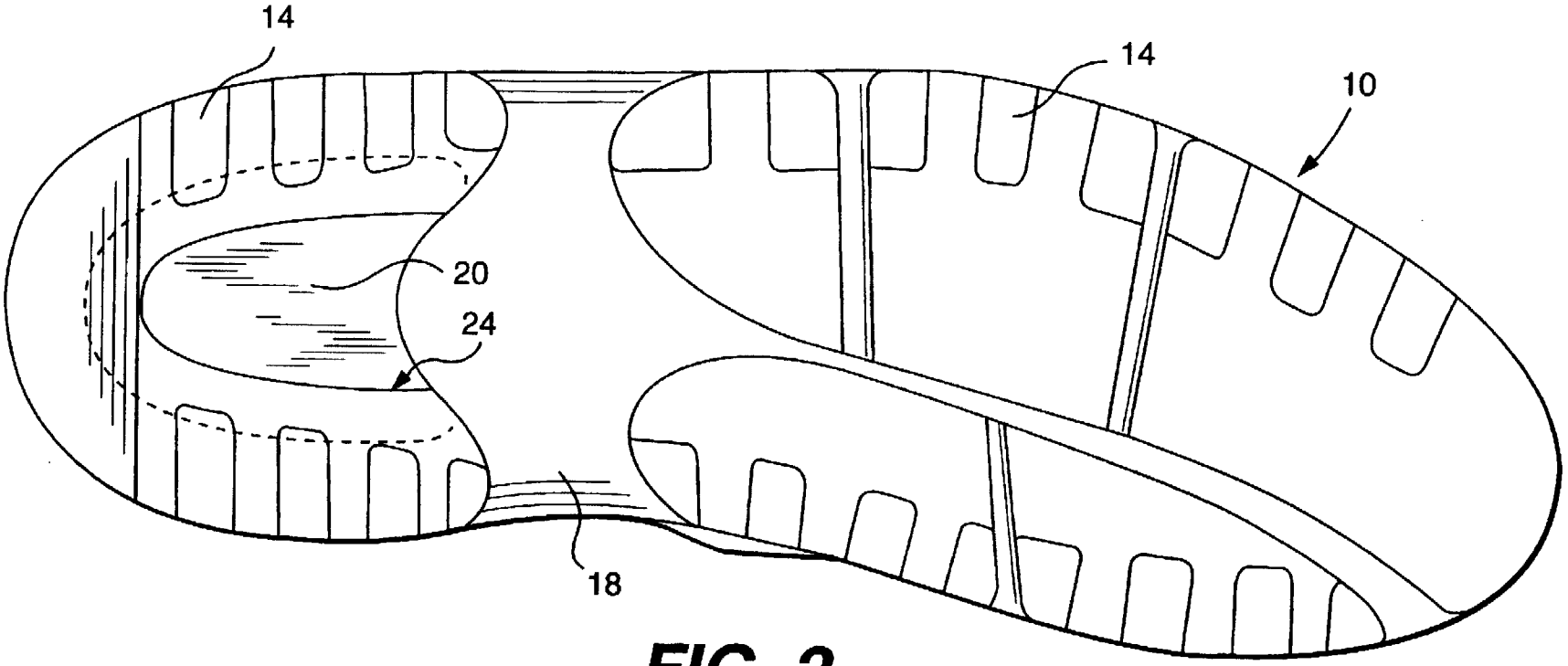
FIG. 2 is a bottom plan view thereof.
Figure 8:
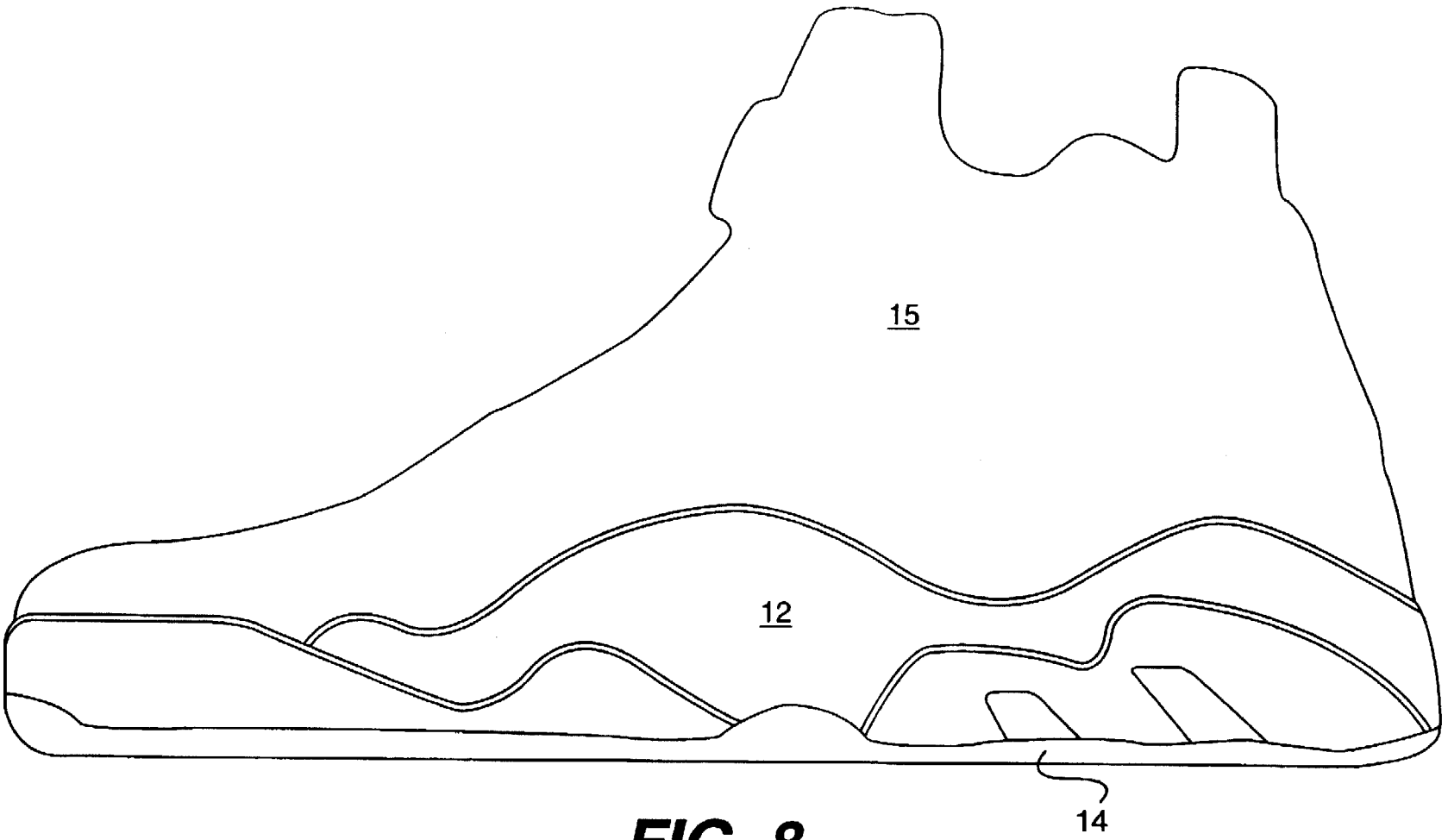
FIG. 8 is a side elevational view of a shoe incorporating the shoe sole shown in FIG. 1.

A cushioned shoe sole in accordance with a preferred embodiment of the present invention is illustrated generally at 10 in FIGS. 1, 2 and 8. Shoe sole 10 includes a midsole layer 12 and an outer sole or outsole layer 14. Shoe sole 10 is attached in a conventional manner, such as with an adhesive, to an upper 15. Shoe sole 10 also includes an inflatable bladder element 20 which is removably positioned in a through-opening 22 extending from a top surface 16 to a bottom surface 18 of midsole layer 12. Midsole layer 12 and bladder element 20 are formed in separate manufacturing processes and then assembled to form sole 10 in a further operation, as discussed in detail below. Exposure of bladder element 20 through the top surface 16 of the midsole layer allows for closer contact between the inflated cushioning element and the foot of a wearer than that accomplished in the prior art. As shown in FIG. 2, an opening 24 may be formed in outsole layer 14 to also allow bladder element 20 to be viewed from the bottom of the shoe sole.

Figure 3:
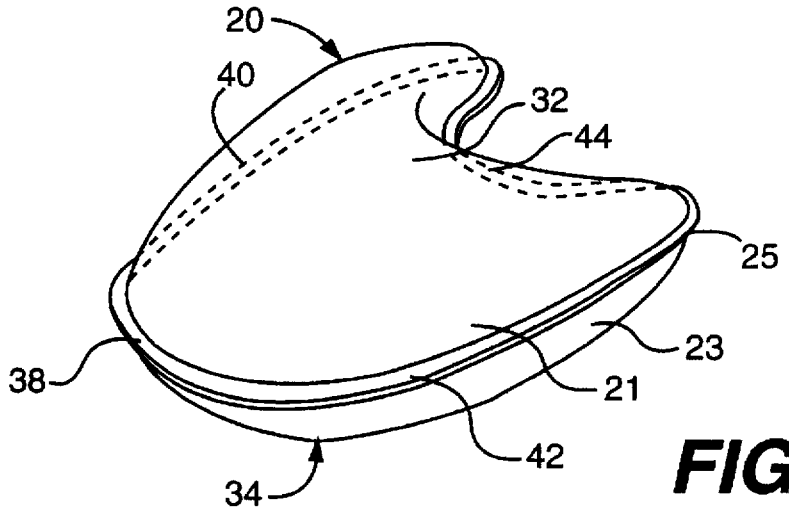
FIG. 3 is a perspective view of the air bladder shown in FIG. 1.

Referring to FIG. 3, inflatable bladder element 20 is illustrated. Bladder element 20 is manufactured using known techniques, such as those described above for the '156 and '945 patents. Bladder element 20 is formed from thermoplastic elastomer film, such as polyester polyurethane, polyether polyurethane and the like. Other suitable materials are identified in the '156 and '945 patents. Contrary to the construction of bladders in these prior patents, bladder 20 is manufactured without intercommunicating chambers or interior weld lines. The interior of bladder 20 has a single unobstructed chamber that is inflated with a gaseous fluid, such as sulfur hexafloride, air and the like. Other suitable gases are identified in the '156 and '945 patents. In a preferred embodiment of the present invention, "air" bladder 20 is formed from a transparent elastomeric film to enable visibility through the bladder and is inflated with sulfur hexafloride to provide consistent and enduring inflation pressure.

In one preferred embodiment, bladder element 20 is formed of a top sheet 21 of elastomeric film and a bottom sheet 23 of elastomeric film. Sheets 21 and 23 are weld to one another along their respective perimeters to define a perimeter weld 25. Top and bottom sheets 21 and 23 curve gradually away from perimeter weld 25 to thereby define a perimeter area of bladder element 20 as the area immediately adjacent the weld. The perimeter or peripheral shape of bladder element 20 is best seen by the hidden line shown in FIG. 1 when within sole 10 and before insertion at sole 10 as shown in FIG. 3. As illustrated therein, bladder element 20 has a convex curved rear edge 38, medial and lateral edges 40 and 42 extending forward and slightly outward from the rear edge, with the medial and lateral edges joined at their rounded forward ends by a concave curved forward edge 44. This bladder configuration has the advantages of being a stable, durable design with maximized gas volume per size of unit. For purposes of reference, the transverse dimension (medial to lateral) of bladder element 20 is denoted as "a". While dimension "a" varies along the length of bladder element 20, it is illustrated at one given location in FIG. 1. Likewise, for purposes of illustration, the longitudinal dimension (front to rear) of bladder element 20 is denoted as "c". While dimension "c" varies along the width of bladder element 20, it is also illustrated at one given location in FIG. 1.

Figure 4:
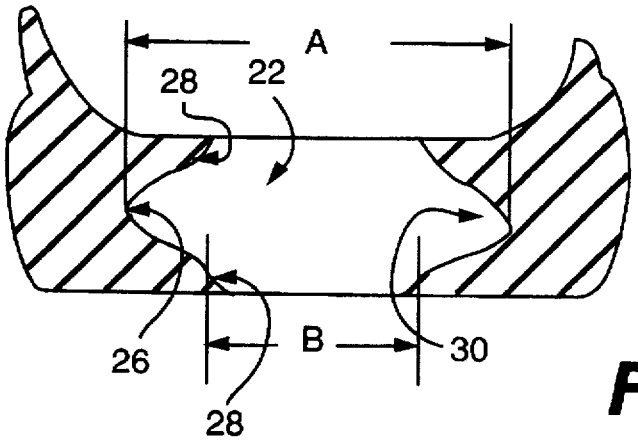
FIG. 4 is a transverse cross-sectional view of the shoe sole shown in FIG. 1 with the air bladder removed therefrom.
Figure 5:
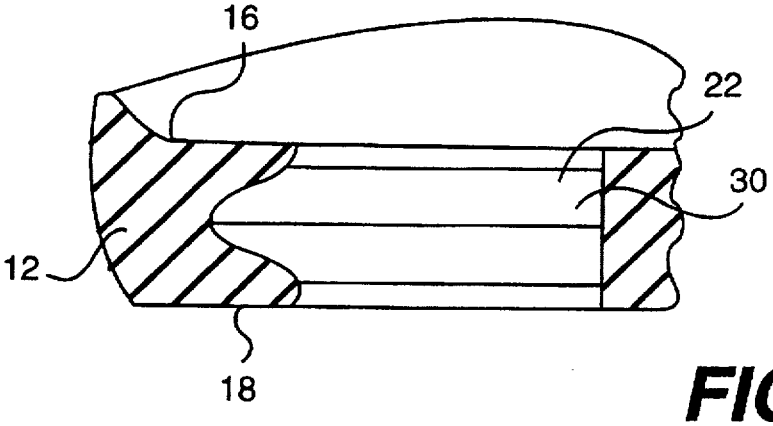
FIG. 5 is a longitudinal cross-sectional view of the shoe sole shown in FIG. 1 with the air bladder removed therefrom.

Midsole layer 12 is molded from a foam material, such as polyurethane, having a preferred specific gravity, such as 0.34 grams/cm$^3$ for example. To take full advantage of the sole construction of the present invention, it is preferred to keep the specific gravity of the foam material below 0.70 grams/cm$^3$. Through-opening 22 designed to receive bladder 20 is molded into the heel area of midsole layer 12. As illustrated in FIGS. 4 and 5, the cross section configuration of through-opening 22 is shown to be generally curved or parabolic. That is, a first opening area 26 is defined generally in the center of midsole layer 12 to accommodate the perimeter of bladder 20 and a second opening area 28 is defined on top surface 16 and preferably on bottom surface 18 of midsole layer 12. First opening area 26 is greater than second opening area 28 such that a generally parabolic cavity 30 is formed between the top and bottom surfaces 16 and 18. As discussed in greater detail below, cavity 30 functions to securely hold inflatable bladder 20 in position.

After manufacturing midsole layer 12 from a preferred material and manufacturing inflatable bladder 20 to obtain a preferred size and pressure, the two components are assembled to form cushioned shoe sole 10. Through-opening 22 is configured to allow an inflated bladder 20 to easily "snap" into position and be securely held. In a preferred embodiment, inflated bladder 20 is disposed directly beneath the heel or calcaneus bone, which is the area of the foot receiving the peak load during impact. When so positioned, cavity 30 of through-opening 22 surrounds the perimeter area of inflated bladder 20 to provide sufficient stability to bladder 20 while also leaving at least a portion of the top surface 32 and bottom surface 34 of bladder 20 exposed. The presence of the overlapping foam of midsole 12 around the perimeter area of bladder 20 within cavity 30 is required to provide support and stability to the unit during impact.

For purposes of reference, the transverse and longitudinal dimensions of first opening area 26 generally correspond to those of bladder 20, that is, the above described "a" and c. The transverse dimension of second opening area 28 at the location of the transverse dimension "a" of bladder element 20 is denoted "b", and the longitudinal dimension of second opening area 28 at the location of the longitudinal dimension "c" is denoted as "d". By comparing dimensions "a" and "b", it is shown that the width of second opening area, "b", is approximately fifty to ninety-five percent of the width of first opening area, "a", and more preferably, dimension "b" is between approximately sixty and seventy-five percent of dimension "a". It is also shown that the overlap of cavity 30 around bladder 20 totals approximately forty percent of the width of the bladder, and by comparing dimensions "c" and "d", the overlap at the rear of bladder 20 is shown to be approximately fifteen to twenty percent of the longitudinal dimension. In order to attain secure retention of bladder 20 within the opening, cavity 30 should overlap at least a majority (greater than fifty percent) of the perimeter area of the bladder, with the overlap being at least greater than ten percent of the transverse or longitudinal dimension of the bladder. The amount of overlap required to securely retain bladder 20 will vary with factors such as the activity in which the shoe will be used, the density of the foam, the inflated pressure of the bladder.

As illustrated, exposure of at least top surface 32 of inflated bladder 20 brings the foot of a wearer into closer contact with the inflated bladder. The superior cushioning benefits of "air" are more perceptible to the wearer due to this close contact and "air" is therefore perceived as being dominate in the cushioning system. Visibility of bladder 20 through the top and/or bottom surfaces of the midsole also increases the wearer's perception of the air. Thus, by combining the use of a transparent film for the manufacture of bladder 20 and the use of through-opening 22 in the midsole, it is possible to create a shoe sole with unrestricted visibility through the vertical plane. If combined with an upper 15 having a transparent lasting sock, visibility could even be obtained through the entire vertical plane of the shoe.

Figure 7:
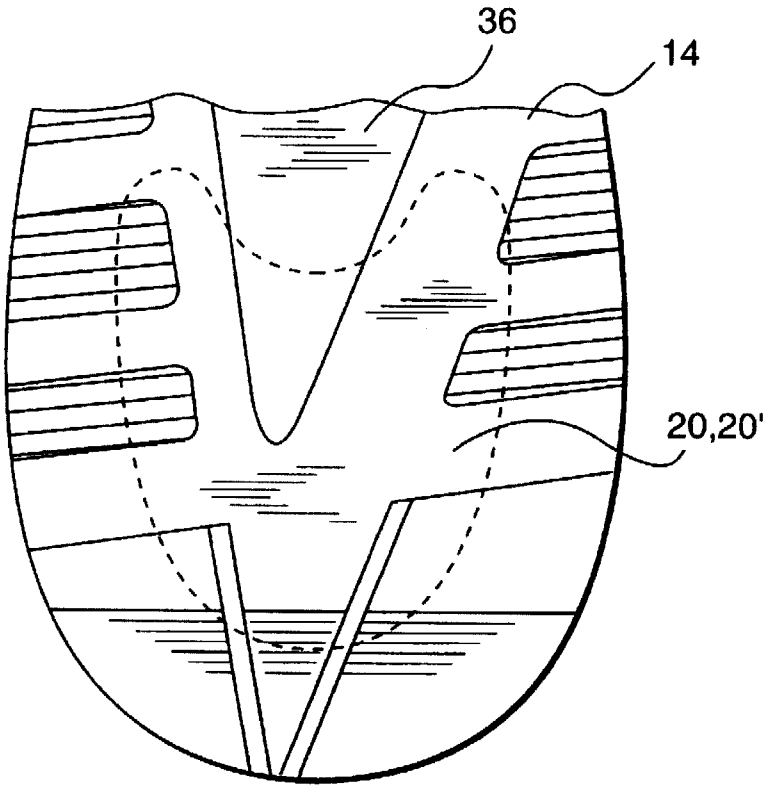
FIG. 7 is bottom plan view of shoe sole according to a yet another embodiment of the present invention.

In a further embodiment of the preferred invention illustrated in FIG. 7, visibility of inflated bladder 20 through bottom surface 18 of midsole layer 12 is prevented by the placement of a heel plate 36 between midsole layer 12 and outsole layer 14. Heel plate 36 helps to contain inflated bladder 20 within through-opening 22 and prevent any deformation of bladder 20 on the bottom of the midsole. In turn, heel plate 36 insures that bladder 20 will not bulge and cause the bottom of the shoe to not sit flat. Heel plate 36 is formed from a rigid, semi-rigid or flexible material (such as polyester polyurethane film) and further serves to protect bladder 20 from damage, such as that inflicted by a sharp object encountered while walking. If visibility is still desired with the added protection provided by heel plate 36, it can, of course, be formed of a transparent material.

Midsole layer 12 and air bladder element 20 are formed in two separate manufacturing processes and then assembled in a combination shoe sole 10. Midsole layer 12 is preferably formed by injection molding a polyurethane foam. The mold is configured to allow formation of through-opening 22 as well as cavity 30. Bladder element 20 is formed as described above, inflated with the desired gas to the preferred pressure, and then sealed. Inflated bladder element 20 is then inserted into corresponding opening 22 in midsole layer 12. Forward edge 44 of bladder 20 is inserted into the forward edge of cavity 30 and rear edge 38 of bladder 20 can then snap into position in the rear of cavity 30. Alternatively, rear edge 38 of bladder 20 is inserted into the rear of cavity 30 and forward edge 44 of bladder 20 is then snapped into position in the front of cavity 30. In the preferred and most efficient method, the rear edge is inserted first into cavity 30. This separate manufacturing and assembly process eliminates many of the manufacturing and performance constraints and problems previously confronted when encapsulating the air bladder during the molding of the midsole.

For instance, by positioning inflated air bladder 20 in preformed through-opening 22 after the midsole is molded, the exposure of bladder 20 to the heat of foam molding is decreased and the consequences of heat exposure are therefore significantly reduced. Any pressurized bladder made from an elastic film is subject to a certain amount of growth and distortion when exposed to heat. The growth of the air bladder in turn reduces its internal pressure and, thus, alters its overall cushioning characteristics. Due to the manufacturing variances encountered in the foam molding stage, such as the amount of heat given off during foam curing or mold dwell times, it is difficult to predict the amount of growth experienced by any specific bladder. Accordingly, by lessening the exposure of air bladder 20 to heat in the present invention, the prior art problems associated with growth, distortion and cushioning deviation are also avoided.

Further, the cushioned shoe sole of the present invention reduces the amount of required foam, due to the lack of depressions between intercommunicating chambers in air bladder 20, and thus produces a lighter midsole having a lesser density. When conventionally encapsulating an air bladder into a polyurethane midsole it was important that the foam material completely fill-in around multi-chamber air bladder in order to form a moderator for the peaks and valleys in the bladder, as well as to secure the bladder in place. In order to accomplish this consistently and with the fewest number of rejected midsoles (containing the more costly air bladders therein), it was necessary to mold the midsole with an excess of foam. This increased foam insured a complete fill around the bladder, but it also increased the midsole density and thereby detracted from the compliancy of the midsole and reduced the wearer's perception of the air bladder. Thus, the density of the midsole foams was typically in the range of 0.38 to 0.45 grams/cm$^3$. In contrast, since the present invention has a single unobstructed interior cavity, and not the peaks and valleys of the prior art, it is no longer necessary to use an excess of foam to insure complete fill-in. The present invention also eliminates the thin, useless layer of foam covering the top and bottom surfaces of air bladder 20 and allows closer contact between the air bladder and the foot. Accordingly, the density of midsole layer 12 of the present invention is reduced. The polyurethane midsole foam in the present invention can therefore have a density below 0.34 grams/cm$^3$, preferably in the range of 0.25 to 0.30 grams/cm$^3$.

From a performance viewpoint, the ability to form midsole layer 12 and bladder 20 as separate elements also expands the potential cushioning limits of both parts. For instance, the present invention allows the combination of an air bladder with a foam midsole that requires high temperature processing. Because only low processing temperature foams could be used to encapsulate inflated bladders, typical foam materials were limited to polyester and polyether polyurethanes. The use of certain types of foam offering desirable cushioning characteristics has heretofore been precluded in encapsulation processes due to the susceptibility of the elastomeric bladders to extensive heat. These foams are now available for combination with an air bladder, however, since the two elements are formed in separate manufacturing steps. Typical high temperature processing foams having sufficient resiliency to form a midsole are ethylene vinyl acetate and sponge rubber. In another instance, bladder 20 is designed without interior welds to provide a larger volume air bladder per given length and width than previously known. That is, without the requirement of moderating foam above and below the bladder element, it is feasible to produce a bladder having a thickness generally equivalent to the midsole thickness. Thus, the thicker bladder therefore provides a greater feel of the air cushioning to the wearer. Thus, the independence between the foam midsole and the air bladder offers more displacement than if the two elements had been encapsulated together.

Most notably in the present invention, the ability to independently interchange the air bladders and the midsoles during manufacturing produces a more versatile, tunable system capable of being designed to meet the specific needs of an individual, e.g., based upon the desired activity, individual weight, desired cushioning, etc. It is also possible to selectively insert and remove air bladders of various stiffnesses in order to vary the compliance of the shoe. Accordingly, the versatility which can achieved in the design of athletic shoe soles provides an unlimited potential for further optimizing the preferred cushioned shoe sole.

Figure 6:
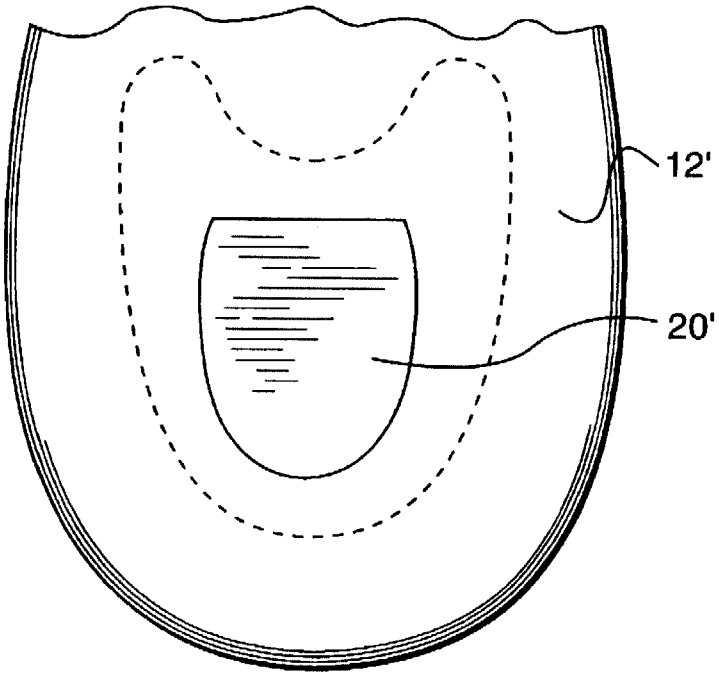
FIG. 6 is a top plan view of a shoe sole according to a further embodiment of the present invention.

The above described preferred embodiment of the invention utilizes the combination of a novel large volume air bladder and separate manufacturing processes to achieve the desired cushioning and perception. In an alternative embodiment of the present invention, the same large volume air bladder is used with the prior art technique of encapsulating it in a polyurethane midsole in a single manufacturing step, such as described in the '945 patent. As illustrated in FIG. 6, bladder 20' is encapsulated in a foam midsole 12' only along the periphery thereof. Since bladder 20' does not have the peaks and valleys of prior art air bladders, the density of the midsole can be reduced because there is no need to insure filling-in of the same. Similarly, as described above, the top and bottom surfaces of bladder 20' are left exposed during the encapsulation process. This enables a closer contact between the foot of the wearer and the air bladder than previously achieved for encapsulated air bladders and eliminates any reduction in cushioning properties caused by the presence of the less resilient foam in the prior art encapsulated bladders. The encapsulation of bladder 20' in accordance with the present invention also allows vertical plane visibility through the midsole. Thus, as described above for the previous embodiment and shown in FIG. 7, an outsole 14 may be provided with an opening generally corresponding to through-opening 22 to allow viewing of bladder 20' and a heel plate 36 may be disposed between midsole layer 12,12' and outsole layer 14 to provide additional protection to bladder 20'.

Various combinations and modifications to the preferred embodiments of the present invention are possible. For instance, both snap-in bladder 20 and encapsulated bladder 20' may be visibly exposed on the top and bottom surfaces by utilizing an outsole with an opening therein. Alternatively, bladders 20 and 20' may be exposed on only the top surface of the midsole or on only the bottom surface of the midsole. Still further, if a transparent film is used to form bladders 20 and 20' and a transparent lasting sock is utilized in a shoe upper attached to the shoe sole, it is possible to create a shoe having vertical plane visibility entirely therethrough. Also, while the bladder is disclosed as being formed of separate sheets of film material welded together around the perimeter, blow-molding or vacuum forming can also be used to form the bladder. If a molded bladder is used, and the bladder has sufficient structural integrity, the bladder may be snap fit into the midsole cavity prior to inflation.

It will be obvious to those of ordinary skill in the art that numerous modifications may be made without departing from the true spirit and scope of the present invention, which is to be limited only by the appended claims.

We claim:

1. A cushioned shoe sole comprising:

an outer sole layer for contacting the ground surface;

a one-piece midsole layer disposed above said outer sole layer having a given thickness, a top surface and a bottom surface, said midsole layer being formed of a resilient elastomeric material and including an opening integrally formed vertically through at least a portion of said midsole layer, said resilient elastomeric material bordering said opening forming a securing surface that is curved along a vertical axis, and said opening extending from an interior surface of said midsole layer through at least one of the top and bottom surfaces of said midsole layer;

a bladder element sealingly containing a fluid medium and having a top surface, a bottom surface, and a perimeter area, said bladder element having an unobstructed interior cavity within said perimeter area; and said bladder element being securable within and removable from said opening in said midsole layer by relative movement between said perimeter area of said bladder element and said curved securing surface of said midsole layer, such that when said bladder element is secured within said opening in said bladder, the perimeter area of said bladder element is securely retained in said opening;

wherein said opening in said midsole layer has a first dimension along a given direction in the interior of said midsole layer and a second dimension along said given direction in at least one of the top and bottom surfaces of said midsole layer, said first dimension being greater than said second dimension and said first dimension being approximately the same as the dimension of said perimeter area of said bladder element inserted into said opening such that said resilient elastomeric material forming said securing surface holds said bladder element within said opening, said securing surface being defined between the interior of said midsole layer having the first dimension and at least one of the top and bottom surfaces of said midsole layer having the second dimension.

2. The cushioned shoe sole according to claim 1, wherein said is fluid medium is a gaseous substance.

3. The cushioned shoe sole according to claim 2 wherein said top surface of said inflated bladder is visibly exposed through a top of said opening in said top surface of said midsole layer.

4. The cushioned shoe sole according to claim 3 further comprising a heel plate disposed between said outer sole layer and said midsole layer beneath said opening in said midsole layer.

5. The cushioned shoe sole according to claim 4 wherein said heel plate is transparent and said outer sole layer includes an opening at least partially corresponding to a bottom of said opening in said midsole layer such that said bottom surface of said inflated bladder is visibly exposed through said opening in said outer sole layer.

6. The cushioned shoe sole according to claim 3 wherein said outer sole layer includes an opening at least partially corresponding to a bottom of said opening in said midsole layer such that said bottom surface of said inflated bladder is visibly exposed through said opening in said outer sole layer.

7. The cushioned shoe sole according to claim 2 wherein said outer sole layer includes an opening at least partially corresponding to a bottom of said opening in said midsole layer such that said bottom surface of said inflated bladder is visibly exposed through said opening in said outer sole layer.

8. The cushioned shoe sole according to claim 2 wherein said resilient elastomeric material of said midsole layer comprises a foam material and said foam material surrounds said periphery area of said inflated bladder.

9. The cushioned shoe sole according to claim 8 wherein said foam material is polyurethane foam.

10. The cushioned shoe sole of claim 8 wherein said foam material has a density less than 0.70 grams/cm$^3$.

11. The cushioned shoe sole according to claim 1 wherein said first direction extends transversely between the medial and lateral sides of the sole.

12. The cushioned shoe sole according to claim 1 wherein said second dimension is between approximately fifty and ninety-five percent of said first dimension.

13. The cushioned shoe sole according to claim 12 wherein said second dimension is between approximately sixty and seventy-five percent of said first dimension.

14. The cushioned shoe sole according to claim 2 wherein said bladder has a thickness at least generally equal to the distance between said top and bottom surfaces of said midsole layer.

15. The cushioned shoe sole according to claim 2 wherein said bladder is disposed in a heel area of said midsole layer.

16. The cushioned shoe sole according to claim 2 further comprising a shoe upper attached above said top surface of said midsole layer to thereby form a shoe.

17. The cushioned shoe sole according to claim 1, wherein said opening extends through said top surface of said midsole layer.

18. The cushioned sole according to claim 1, wherein said opening extends through said top and bottom surfaces of said midsole layer.

19. A cushioned shoe sole comprising:

an outer sole layer for contacting a ground surface;

an unitary midsole layer disposed above said outer sole layer having a top surface and a bottom surface, said midsole layer being formed of a resilient elastomeric material and including an opening formed vertically through at least a portion of the midsole layer including its top surface;

a bladder element sealingly containing a fluid medium and having a top surface, a bottom surface, and a perimeter area, said bladder element having an unobstructed interior cavity within said perimeter area, said bladder element being encapsulated in said elastomeric material of said midsole layer along its perimeter area such that at least said top surface of said bladder element is exposed through a top portion of said opening in said midsole layer to thereby allow close contact between a wearer's foot and said bladder element;

wherein said opening in said midsole layer has a first dimension along a given direction in the interior of said midsole layer and a second dimension along said given direction in the top surface of said midsole layer, said first dimension being greater than said second dimension and said first dimension being approximately the same as the dimension of said perimeter area of said bladder element inserted into said opening such that said resilient elastomeric material forms a securing surface for holding said bladder element within said opening, said securing surface being defined between the interior of said midsole layer having the first dimension and the top surface of said midsole layer.

20. The cushioned shoe sole according to claim 19 wherein said opening in said midsole layer is also formed through said bottom surface thereof and said outer sole layer includes an opening at least partially corresponding to said opening in said bottom surface of said midsole layer such that said bottom surface of said inflated bladder is visibly exposed through said opening in said outer sole layer.

21. The cushioned shoe sole according to claim 20 wherein said inflated bladder element is formed from transparent material such that visibility is obtained in the vertical plane from said top surface of said midsole through said outer sole layer.

22. The cushioned shoe sole according to claim 20 further comprising a heel plate disposed between said outer sole layer and said midsole layer beneath said opening in said midsole layer.

23. The cushioned shoe sole according to claim 22 wherein said heel plate is transparent.

24. The cushioned shoe sole according to claim 19, wherein said midsole layer comprises a foam material.

25. The cushioned shoe sole according to claim 24 wherein said foam material is polyurethane foam.

26. The cushioned shoe sole according to claim 19 wherein said bladder has a thickness at least generally equal to the distance between said top and bottom surfaces of said midsole layer.

27. The cushioned shoe sole according to claim 19 wherein said bladder is made from a thermoplastic elastomer.

28. The cushioned shoe sole according to claim 27 wherein said thermoplastic elastomer is transparent.

29. The cushioned shoe sole according to claim 19 further comprising a shoe upper attached to said top surface of said midsole layer to thereby form a shoe.

30. The cushioned sole according to claim 19, wherein said opening is formed vertically through a portion of the midsole layer including its bottom surface.

31. A method of forming a cushioned shoe sole comprising the steps of:

forming a bladder element from an elastomeric material having a perimeter, a hollow interior chamber within the perimeter, and a fluid medium sealingly contained in the chamber;

molding a unitary midsole from a foam elastomeric material, the midsole extending in longitudinal, transverse and vertical directions, and having opposing upper and lower major surfaces;

forming an opening in the midsole, the formed opening vertically extending through and from at least one of the upper and lower major surfaces into the interior of the midsole, said formed opening including an integral peripheral cavity within the midsole having a first dimension along a given direction in the interior of the midsole and a second dimension along the given direction in said at least one of the upper and lower major surfaces of the midsole, the first dimension being greater than the second dimension and the first dimension being approximately the same as the dimension of the perimeter of the bladder element to be inserted into the opening such that the elastomeric material of the midsole forms a securing surface for holding the bladder element within the opening, the securing surface being defined between the interior of the midsole having the first dimension and said at least one of the upper and lower major surfaces of the midsole having the second dimension securing surface, the securing surface curving in a vertical direction around at least a major portion of the perimeter of the opening;

inserting the bladder element into the opening to releasably secure the bladder element to the midsole and within the opening in the midsole by positioning the perimeter of the bladder element within the peripheral cavity securing surface around the perimeter of the bladder element.

32. The method according to claim 31 wherein said forming an opening step forms the opening in the lower major surface of the midsole and the method further comprising providing an outsole having an opening corresponding at least in part to the opening in the lower major surface of the midsole and, after said inserting step, affixing the outsole to the lower major surface of the midsole and viewing the inflated bladder through the opening in the outsole.

33. The method according to claim 31 wherein said forming an opening step forms the opening in the lower major surface of the midsole and the method further comprising attaching an outsole to the lower major surface of the midsole for contacting the ground surface and affixing a heel plate over the opening in the lower major surface of the midsole between the outsole and the midsole.

34. The method according to claim 31 wherein the perimeter of the bladder is defined by the front, rear, medial and lateral edges of the bladder and said inserting step includes inserting at least a portion of the front edge of the bladder into the peripheral cavity and then applying a slight pressure to force at least a portion of the medial, lateral and rear edges into the peripheral cavity.

35. The method according to claim 31 wherein the perimeter of the bladder is defined by the front, rear, medial and lateral edges of the bladder and said inserting step includes inserting at least a portion of the rear edge of the bladder into the peripheral cavity and then applying a slight pressure to force at least a portion of the medial, lateral and front edges into the peripheral cavity.

36. The method according to claim 31, further comprising, before said inserting step, inflating the bladder with the fluid medium and sealing the bladder to retain the fluid medium therein.

37. The method according to claim 31 wherein the forming an opening step forms the opening in the upper major surface of the midsole.

38. The method according to claim 31 wherein the forming an opening step forms the opening in both the upper and lower major surfaces of the midsole.

* * * * *

UNITED STATES PATENT AND TRADEMARK OFFICE

CERTIFICATE OF CORRECTION

PATENT NO. : 5,685,090
DATED : November 11, 1997
INVENTOR(S) : John C. Tawney and Bruce J. Kilgore It is certified that error appears in the above-identified patent and that said Letters Patent is hereby corrected as shown below:

In Claim 2, column 8, line 35, delete the word "is" in the first instance.

Signed and Sealed this

Third Day of February, 1998

*Attest:*

*Attesting Officer*

BRUCE LEHMAN

*Commissioner of Patents and Trademarks*